United States Patent [19]

Schaller

[11] Patent Number: 4,662,526

[45] Date of Patent: May 5, 1987

[54] HOISTING MECHANISM FOR THE COVER OF A FURNACE

[75] Inventor: Hans-Ludwig Schaller, Duisburg, Fed. Rep. of Germany

[73] Assignee: Mannesmann Aktiengesellschaft, Dusseldorf, Fed. Rep. of Germany

[21] Appl. No.: 744,411

[22] Filed: Jun. 13, 1985

Related U.S. Application Data

[62] Division of Ser. No. 379,279, May 17, 1982, abandoned.

[51] Int. Cl.[4] ..... B66C 11/12

[52] U.S. Cl. ..... 212/166; 110/177; 110/180; 110/173 R; 373/73; 373/81; 414/684.3

[58] Field of Search ..... 110/173 R, 176–177, 110/180; 49/210, 324; 262/248, 262; 373/71, 73, 81, 84, 106; 414/684.3; 212/166, 213–214, 226, 229, 250–252

[56] References Cited

U.S. PATENT DOCUMENTS

| | | |
|---|---|---|
| 1,671,100 | 5/1928 | Cort et al. . |
| 2,313,837 | 3/1943 | Nissim . |
| 2,396,663 | 3/1946 | Kuehlthau et al. . |
| 2,944,100 | 7/1960 | Sorg et al. . |
| 3,428,301 | 2/1969 | Chermely . |
| 3,745,224 | 7/1973 | Ames . |
| 3,812,275 | 5/1974 | Schempp et al. . |
| 3,980,801 | 9/1976 | Milasius . |
| 4,123,617 | 10/1978 | Wynne . |

FOREIGN PATENT DOCUMENTS

| | | |
|---|---|---|
| 1033233 | 7/1958 | Fed. Rep. of Germany . |
| 1067984 | 10/1959 | Fed. Rep. of Germany . |
| 1508471 | 1/1970 | Fed. Rep. of Germany . |
| 432086 | 6/1975 | U.S.S.R. . |
| 832291 | 5/1981 | U.S.S.R. . |

*Primary Examiner*—Joseph F. Peters, Jr.
*Assistant Examiner*—R. B. Johnson
*Attorney, Agent, or Firm*—Mandeville & Schweitzer

[57] ABSTRACT

A hoisting mechanism for handling the cover of an electric arc furnace comprises a pivotable gantry base and gantry arms connected thereto which extend over the furnace cover. Traverse bars overlay the gantry arms and are connected to the furnace cover by hoisting rods which pass through the gantry arms. Lifting mechanisms preferably in the form of hydraulic piston-cylinder arrangements are secured, on one end, to the gantry arms and, on the other end, to the lower side of the traverse bars. The mechanism is electrically insulated to eliminate deterioration of the equipment and the existence of electrical circuits and, in addition, the hoisting rods and the piston cylinder mechanisms are water-cooled.

4 Claims, 5 Drawing Figures

HOISTING MECHANISM FOR THE COVER OF A FURNACE

CROSS REFERENCE TO RELATED APPLICATION

This is a division of application Ser. No. 379,279, filed May 17, 1982, now abandoned.

BACKGROUND OF THE INVENTION

The present invention relates to a hoisting apparatus for a cover of an electric arc furnace or similarly bulky object. Basically, two gantry arms extend across the cover. Traverse bars overlay the gantry arms and are provided with hoisting rods, which may selectively be lifted and lowered with the cover. The cover is raised by a hydraulic lifting mechanism, in the form of a plunger mechanism or a piston-cylinder device. The gantry and traverse arms are water cooled to protect the lifting rods and the lifting mechanisms.

DESCRIPTION OF THE PRIOR ART

A hoist installation of the general type is shown by German reference DE-OS No. 15 08 471. The gantry-type arm, there shown, is pivotal around a vertical axis. That hoist apparatus is equipped with many closely arranged joints which are above the approximately 35-t cover of the electric arc furnace. The gantry arm is thus exposed to a temperature of approximately 400° C., which can cause deformation of the gantry arm and damage to the hoist mechanism, particularly the joints. The mechanism must, to avoid down time, be protected from damage by electrical current by having the mechanism bridged by electrically conductive copper. Attempts have been made to limit the influence of the heat by using heat-protective metal sheets arranged below the cover support. This is, however, not satisfactory because the metal sheets hinder access to the other equipment arranged in or on the cover and, as the electrodes, hot to about 1,500° C., move upwardly, their heat radiation affects the metal sheets to the extent that they tend to bend and drop off. Subsequently, the copper bridges and the bearings of the many joints are detrimentally exposed to the high temperature.

SUMMARY OF THE INVENTION

The object of the present invention is, therefore, the provision of a hoist mechanism for a cover for an electric arc furnace which is relatively immune to heat and the effects of electric current. This object is achieved by arranging, according to the present invention, at least one hydraulic-type plunger device or cylinder and piston in each gantry arm and having it connected with a traverse bar arranged above the gantry arm. Pulling or hoisting rods connected to the traverse bars, passing through the gantry arm to the cover. The presently inventive hoisting mechanism has no swivel joints which would otherwise be subject to damage. Instead, pulling or hoisting rods, having connecting bolts made of temperature-resistant steel, are used. The upper connecting bolts are located above the gantry arm and, therefore, are in a cooler area since the pulling or hoisting rods are more remote from the heat source, i.e., they are not as close to the electric arc furnace.

The object of the present invention, according to a further characteristic of the invention, is accomplished by providing protective pipes splashed, i.e., in contact with circulating cooling fluid. The cooling fluid surrounds the pulling or hoisting rods and the hoisting piston-cylinder mechanisms. The gantry arms of the invention and the traverse bars are provided with fluid-type connections for a cooling fluid feed-in and a cooling fluid drainage so that the coolant passes by and cools the hoisting mechanism and its support structure in a precise and simple controlled manner. The protective pipes will thus operate at the temperature of the coolant and can be kept below a temperature of approximately 50° C. without any difficulty. The fact that the temperature may be kept down to this degree is particularly important for the hydraulic hoisting mechanism. The gantry arm, itself, may be provided with reinforcements in the area of the protective pipes for the hydraulics.

In order to eliminate an electrical circuit, an insulating plate may be arranged in the protective pipe environment, i.e., beneath the cylinder of the hoisting hydraulic mechanism. An insulating sleeve is also arranged within the protective pipe for the pulling or hoisting rod. A guide pipe is also provided for the pulling or hoisting rod; it being maintained within the insulating sleeve. The lug of the pulling or hoisting rod is movable and surrounded by insulator rings mounted on a bolt located at the pivotal axis of the traverse bar. Therefore, the traverse bar and the gantry arm, with the elements contained therein, remain free from electric currents since they are insulated therefrom.

In yet a further development of the present invention, a locking support bar passes downwardly through the gantry arm, from the traverse bar, as well as through the gantry base and a gantry platform to the electric arc furnace platform. The platform is provided with a vertical pivotal axis of the gantry arm and a locking mechanism or detent for the locking bar. The locking support bar is retracted from its locking position as the cover lifts up. This, therefore, makes it possible to rotate the gantry arm.

Two exemplary embodiments of the present invention are represented in the drawings and explained as follows:

DETAILED DESCRIPTION OF THE DRAWINGS

Figure 1:
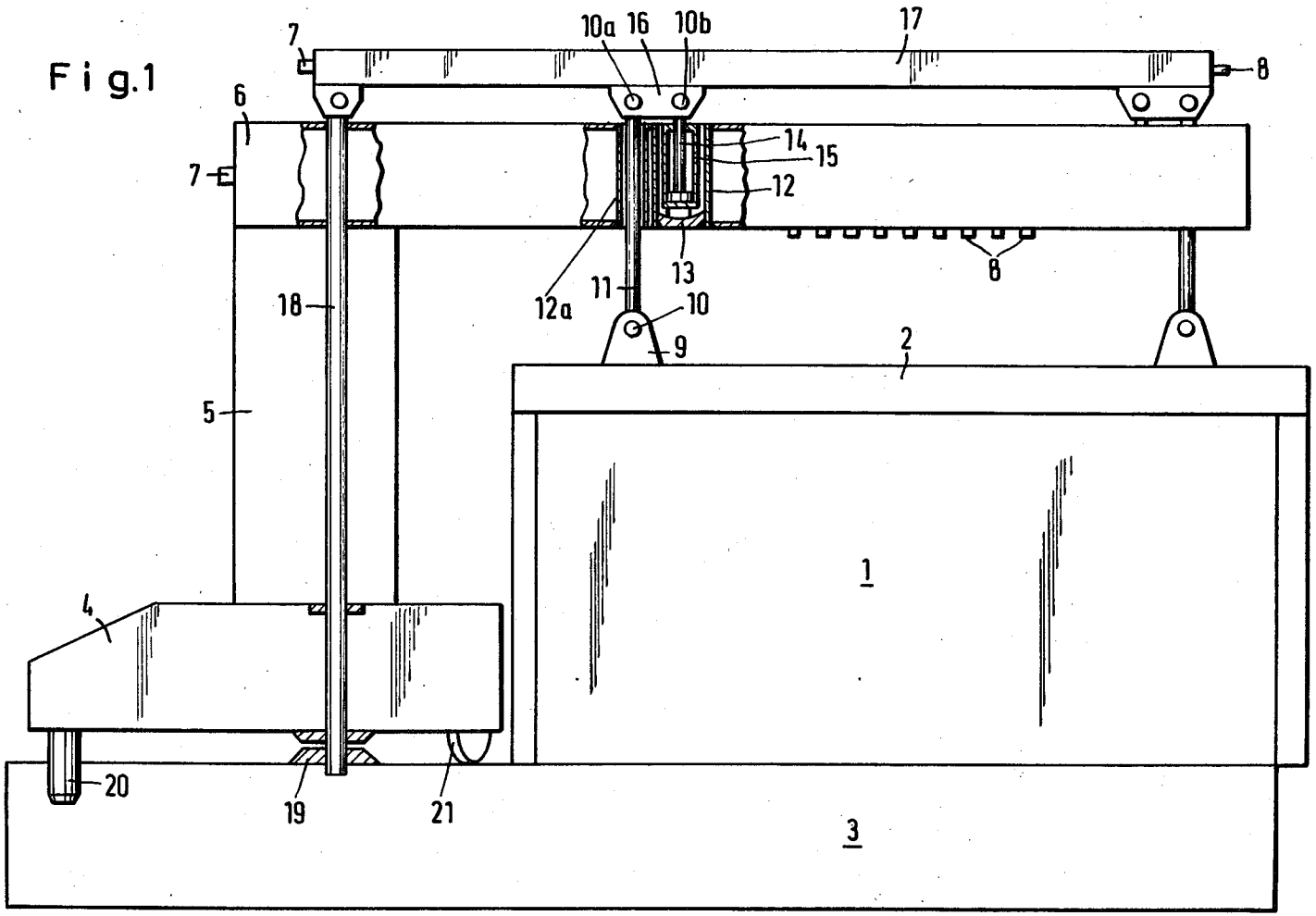
FIG. 1 is a side elevational view of an electric arc furnace with a hoisting mechanism for the cover.

An electric arc furnace 1 is selectively provided with a disc-shaped cover 2. The furnace is supported on a furnace platform 3. Located in front of the arc furnace 1, i.e., to the left in FIG. 1, is a gantry 4 which is also supported on furnace platform 3. The gantry 4 is rotatably arranged about support pin 20, on wheels 21. The gantry 4 has two gantry bases or vertical support members 5 (see FIG. 1) arranged adjacent to each other. The gantry bases 5 are each provided with horizontally extending gantry arms 6 which are made of cylindrically shaped pipes. Traverse bars 17 are arranged above gantry arms 6. Locking support bars 18 pass from traverse bars 17, through the gantry arms 6 and the gantry vertical support members 5, as well as though the gantry 4. The locking support bars 18 also pass through bearing plates 19 which are themselves secured to the furnace platform 3.

The furnace cover 2 has four pivot bearings 9 secured to its upper side by bolts 10. The pulling or hoisting rods 11 pass through protective pipes 12*a* (see FIG. 5) which are welded to the gantry arm 6. A traverse bar support 16 has bolts 10*b* (see FIG. 1) passing through ears of extensions of piston rods 14 which are themselves guided in cylinders 15. The piston rods 14 and cylinders 15 are the preferred embodiment of the lifting mechanism. A hydraulic device can be used, in the same manner as the piston-cylinder units, as the lifting mechanisms. The piston rods 14 enable the furnace cover 2 and the locking support bars 18 to be selectively raised once the cylinders of the piston rods 14 are charged with pressure from below. The cylinders 15 in which piston rods 14 operate are surrounded by protective pipes 12. Electrically insulating resilient plates 13 are maintained below cylinders 15 (see FIG. 1) or a bearing plate 25 when plunger element 24 is used (see FIG. 3).

Both the gantry arms 6 and the traverse bars 17 are provided with inlets 7 for cooling fluid and drainage connections 8 for the cooling fluid. The fluid flows through the traverse bars 17 and the gantry arms 6. The cooling fluid thus cools the protective pipes 12 and 12*a* and the elements arranged therein.

Figure 2:
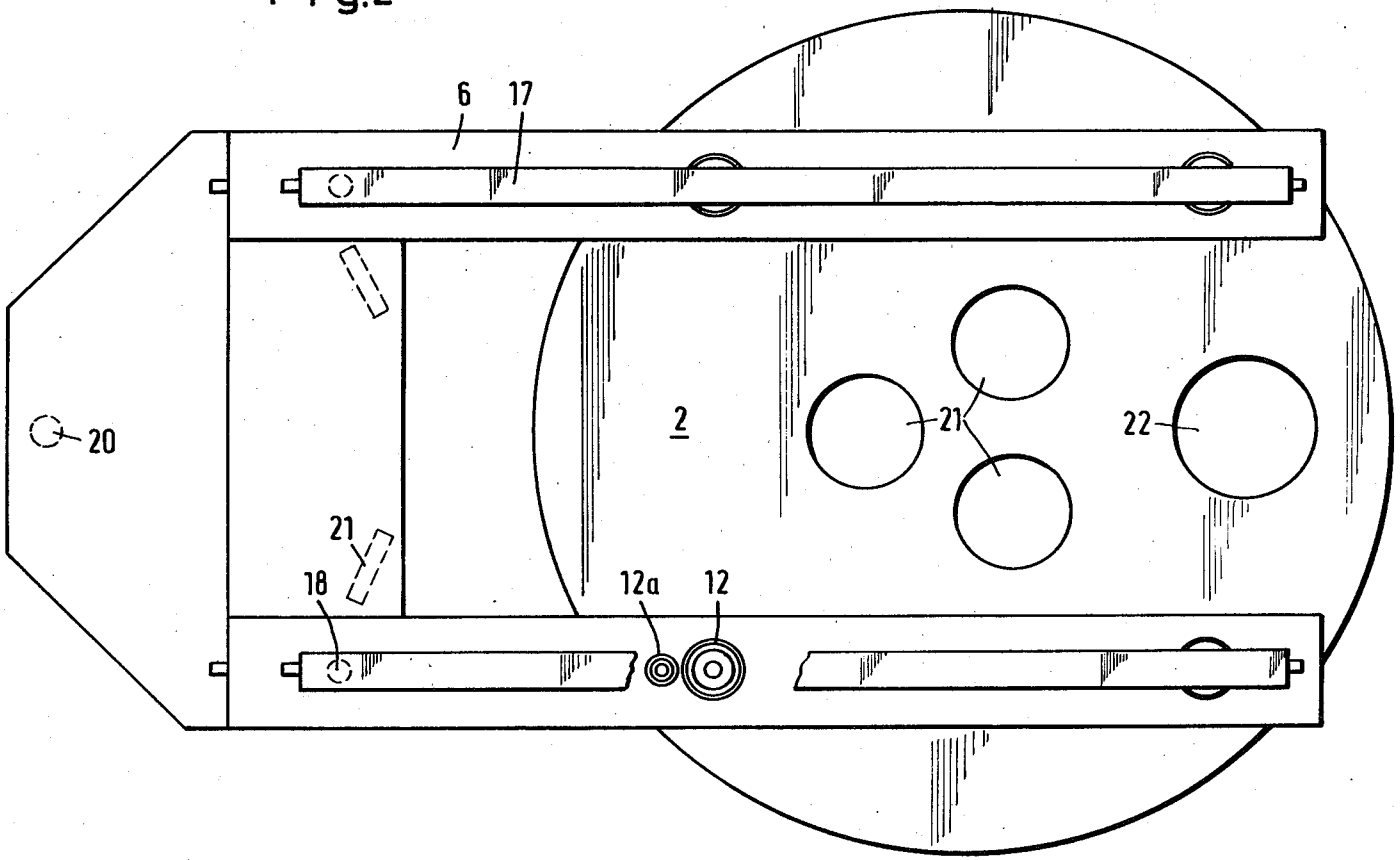
FIG. 2 is a top plan view, partially in section (the reinforcing plates not being shown for clarity of illustration), of FIG. 1.

FIG. 2 shows the arrangement of the protective pipes 12 and 12*a* for the hoist installation. As there seen, the lifting mechanisms, contained within protective pipes 12 and the adjacently located pulling or hoisting rods 11, passing through protective pipes 12*a* are arranged in an even distribution on the surface of the furnace cover 2. The cover 2 is provided with three apertures 21 for allowing the passage of the electrodes and, in addition, an aperture 22 for a vacuum draining apparatus.

Figure 3:
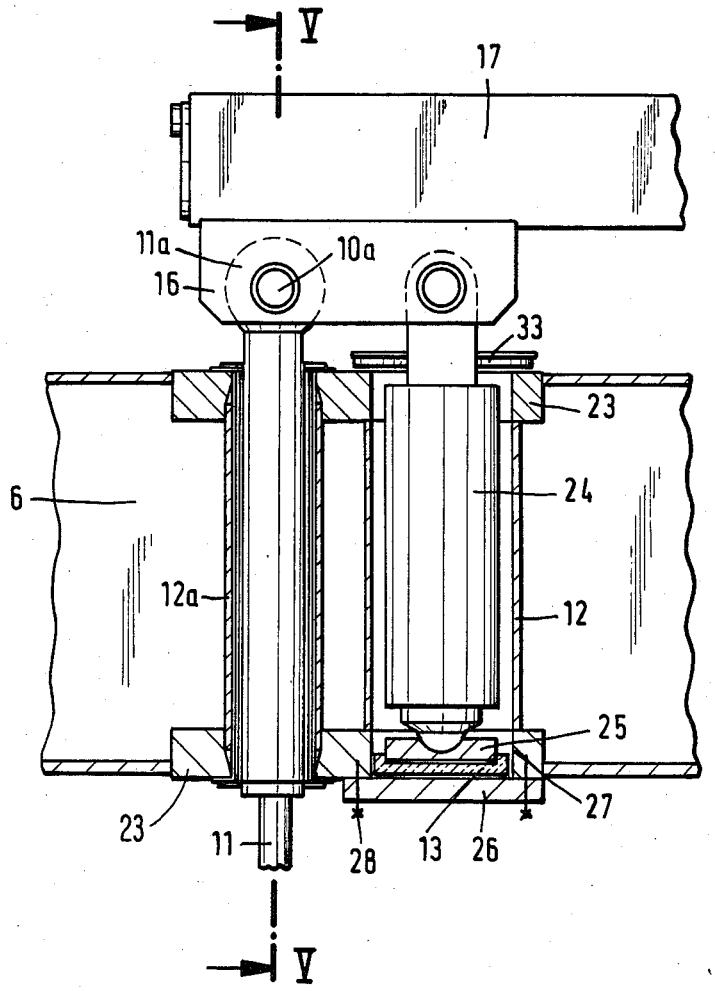
FIG. 3 is a partial, enlarged in scale, cross sectional view similar to that of FIG. 1, showing a second embodiment of the hoisting rods and lifting mechanism in the gantry arm.
Figure 4:
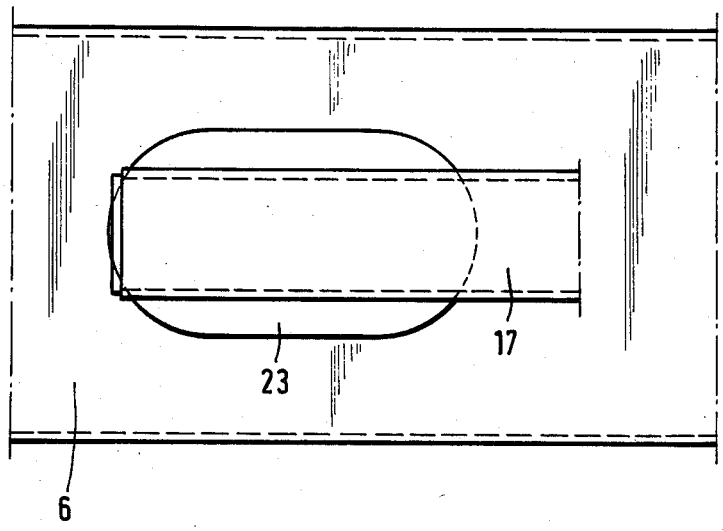
FIG. 4 is a partial top plan view of the traverse bar overlying the reinforcement plate of the below-located gantry arm.
Figure 5:
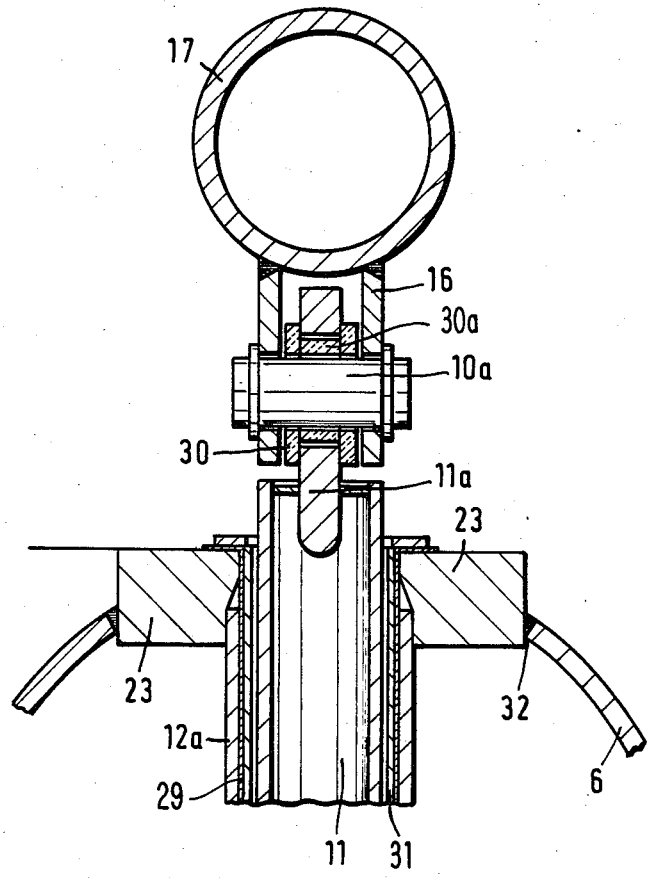
FIG. 5 is a partial cross sectional view of FIG. 3, on a larger scale, taken along the lines V—V.

FIGS. 3 to 5 show the arrangement of upper and lower reinforcement plates 23, made of smooth surfaces that serve to protect the gantry arm 6 in the area of the protective pipes 12 and 12*a*. Instead of the piston cylinder units shown in FIG. 1, a plunger element 24 is provided to the hoist installation. It is supported by a bearing plate 25 and the insulating resilient plate 13 located on a stop plate 26. A bore 27 in the lower reinforcement plate 22 allows for replacement of the plunger 24, after screws 28 (schematically shown) have first been loosened. The tapered pulling or lifting rod 11, in its lower portion, extends downwardly through a sliding pipe 31 (see FIG. 5) located within an insulating sleeve 29. Insulating sleeve 29 is inserted in the protective pipe 12*a*. The ear or extension 11*a* of the pulling rod 11 is secured to the bolt 10*a* of the bearing pivot 16 arranged beneath the traverse bar 17. The hole of ear or extension 11*a* is lined with an electrically insulating ring 30*a* which surrounds bolt 10*a*. Insulator rings 30 surround bolt 10*a* and together with ring 30*a* electrically insulate the bolt 10*a* and traverse bar 17 from the furnace cover. The electrically insulating members 30*a*, 13, 29 and 30 prevent the occurrence of the completion of an electrical circuit. A protective cap 33 (see FIG. 3) protects the plunger element 24 from dirt.

The upper and lower reinforcements 23 together with the protective pipes 12 and 12*a* are approximately 1 meter in height, approximately 1 m in length, and approximately 0.5 meter in depth. Together, the reinforcements and protective pipes weight approximately 2 tons. Such units are welded in openings 32 of the gantry arm 6, the openings having been cut out with a welding torch.

It should be understood, of course, that the specific form of the invention herein illustrated and described is intended to be representative only, as certain changes may be made therein without departing from the clear teachings of the diclosure. Accordingly, reference should be made to the following appended claims in determining the full scope of the invention.

I claim:

1. A hoisting mechanism for handling the furnace cover of an electric arc metallurgical furnace, comprising:
   (a) a vertical support member mounted on a gantry base pivotable about a vertical axis;
   (b) horizontally extending hollow gantry arm means provided with a circulating cooling water means, said gantry arm means being vertically spaced above the furnace cover;
   (c) a hollow traverse bar parallel to and overlying said gantry arms means and spaced upwardly therefrom, said traverse bar provided with a circulating cooling water means;
   (d) hydraulic lifting means located in said gantry arms means and connected between said gantry arms means and said traverse bar, said lifting means being operative to selectively raise or lower said traverse bar with respect to said gantry arm means;
   (e) said lifting means being located in a first protective pipe means mounted in said gantry arm means and supported by a bearing plate and an electrically insulating plate secured in said gantry arm means;
   (f) a hoisting rod connected between said traverse bar and the furnace cover;
   (g) a second protective pipe means located in said gantry arm means and housing an electrically insulating sleeve means mounted therewithin;
   (h) electrically insulating ring means; said hoisting rod being electrically insulated from said traverse bar by said ring means.

2. A hoisting mechanism as claimed in claim 1, wherein:
   (a) said lifting means is a plunger-type mechanism.

3. A hoisting mechanism as claimed in claim 1, wherein:
   (a) said lifting means is a rod-piston mechanism.

4. A hoisting mechanism as claimed in claim 1, further comprising:
   (a) a locking mechanism for securing said furnace cover in a raised position above said electric arc metallurgical furnace;
   (b) said locking mechanism extending from said traverse bar to said gantry base; and
   (c) a locking release means for selectively unlocking said locking mechanism to thereby allow said furnace cover to be lowered onto said electric arc metallurgical furnace.

* * * * *